US005771819A

United States Patent [19]

Saitoh

[11] Patent Number: 5,771,819

[45] Date of Patent: Jun. 30, 1998

[54] INCINERATING FURNACE

[76] Inventor: Shigeru Saitoh, 169, Dai, Obamamachi, Iwaki-shi, Fukushima 974, Japan

[21] Appl. No.: 750,446

[22] PCT Filed: Mar. 27, 1996

[86] PCT No.: PCT/JP96/00793

§ 371 Date: Nov. 26, 1996

§ 102(e) Date: Nov. 26, 1996

[87] PCT Pub. No.: WO96/30699

PCT Pub. Date: Oct. 3, 1996

[30] Foreign Application Priority Data

Mar. 27, 1995 [JP] Japan ..... 7-091986

[51] Int. Cl.[6] ..... F23K 3/00

[52] U.S. Cl. ..... 110/267; 110/248; 110/256; 110/291

[58] Field of Search ..... 119/248, 255, 119/256, 259, 291, 267

[56] References Cited

U.S. PATENT DOCUMENTS 3,561,378 2/1971 Fabry ..... 110/8
5,081,940 1/1992 Motomura et al. ..... 110/346
5,195,449 3/1993 Michimae ..... 110/257
5,241,916 9/1993 Martin ..... 110/348

*Primary Examiner*—Ira S. Lazarus
*Assistant Examiner*—Nhat-Hang H. Lam
*Attorney, Agent, or Firm*—Flynn, Thiel, Boutell & Tanis, P.C.

[57] ABSTRACT

A hearth particle bed incineration furnace is provided in which the hearth particles form a sloped layer bed which moves in the incinerating furnace without being fluidized. The furnace is structured so that the combustion gas is prevented from flowing upward through the inlet for the materials to be incinerated. The structure for preventing the backflow of the combustion gas includes a sidewall which is connected to the incinerated materials inlet, baffles and a member which restrains the upward backflow of combustion exhaust gas. This restraining member is made up of an air intake opening and the air introduced therein is heated through heat exchange with a combustion gas and introduced into the combustion chamber. This allows the amount of air to be introduced in the combustion chamber to be increased and the backflow of combustion exhaust gas to be reduced or eliminated.

3 Claims, 6 Drawing Sheets

INCINERATING FURNACE

FIELD OF THE INVENTION

The present invention is directed to an incinerating furnace which utilizes hearth mineral particles, which move or flow without being fluidized, as a hearth bed upon which a combustible material is decomposed.

BACKGROUND OF THE INVENTION

Air intakes of prior art incinerating furnaces, such as illustrated in Japanese Laid Open Hei No. 4-15404 (Kokai No. 92-15404) or Japanese Patent Application Specification Hei 5-242170 (No. 93-242170), which have the same inventor as the present application, generally draw air freely without any special restrictions on gas flow.

The present invention provides an incinerating furnace which restrains the upward backflow of combustion gas into a materials inlet portion of the furnace, supplies combustion air to the combustion chamber in a sufficiently large amount and at a high temperature and vents gas from the materials inlet portion to the combustion chamber and thereby avoids the problems associated with the prior art incinerating furnaces.

SUMMARY OF THE INVENTION

It is an object of the present invention to provide a hearth particle bed incinerating furnace comprising an inlet portion containing a hopper for materials to be incinerated, means for restraining the upward backflow of combustion gas comprising the hopper, at least one baffle, a combustion air inlet and a sidewall member provided underneath the hopper, a furnace sidewall which extends around and underneath the sidewall member, a hearth particle inlet which comprises a chamber formed between the furnace sidewall and a furnace outerwall, an inclined channel member attached to the furnace outerwall and provided underneath the hearth particle inlet, a sloped hearth bed formed on the inclined channel member with the sloped hearth bed being made up of a layer of hearth particles which flow down the inclined channel member without being fluidized and at an angle approximately equal to the angle of repose of the hearth particles, the combustion chamber comprising the sloped hearth bed, a lower portion of the furnace outerwall and a lower portion of the furnace sidewall, a furnace outlet provided underneath the combustion chamber for discharging a combustion mixture or burnt residues and hearth particles from the combustion chamber, means for removing combustion gas provided at an upper portion of the combustion chamber, means for removing combustion air through the combustion air outlet, means for introducing the combustion air into the lower hearth bed for combustion, a movable plane member provided underneath the furnace outlet for removing the combustion mixture and means for regulating the discharge of the combustion mixture so that the combustion mixture deposits on the movable plane member at an angle approximately equal to the angle of repose of the hearth particles.

In one embodiment of the present invention, the combustion air is mixed with a portion of the combustion exhaust gas to form a mixed gas which is then introduced into the lower hearth bed for combustion. In another embodiment of the present invention, the combustion air is heated through heat exchange with the combustion exhaust gas before being introduced into the hearth particle bed for combustion. In yet another embodiment of the present invention, the combustion air is heated through heat exchange with the combustion exhaust gas and then mixed with a portion of the combustion exhaust gas to form a mixed gas which is then introduced into the hearth particle bed for combustion.

DESCRIPTION OF THE PREFERRED EMBODIMENTS

Figure 1:
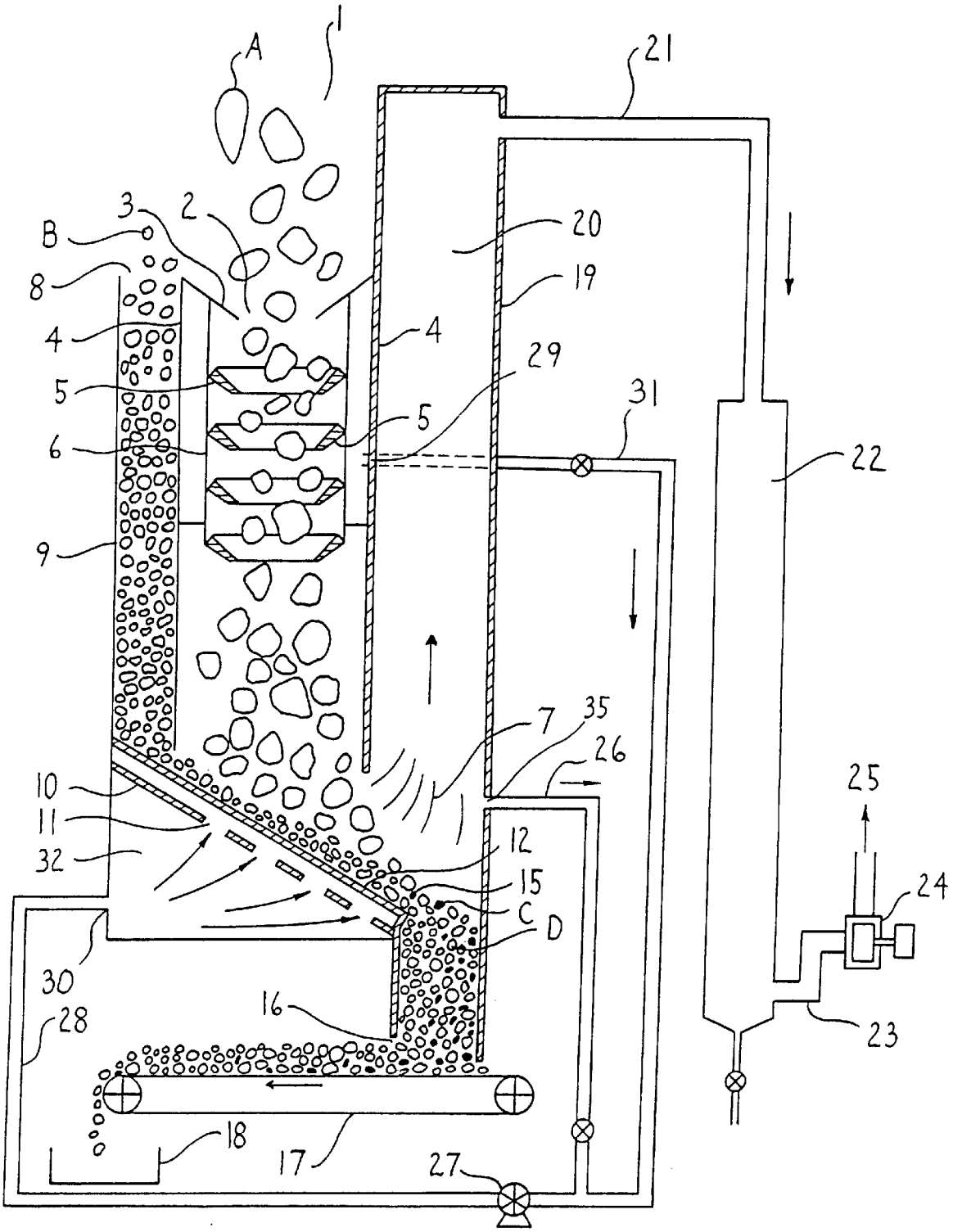
FIG. 1 is a partial sectional view of an incinerating furnace according to a first embodiment of the present invention.

As illustrated in FIG. 1, the hearth particle incinerating furnace according to a first embodiment of the present invention is made up of an inlet 1 through which burning materials A are introduced into a hopper 3 of the furnace. The opening 2 of the hopper decreases as it extends into the furnace to avoid contact of the furnace sidewalls 4 with the burning material. Angular baffles 5 having a central opening which decreases as it extends along the length of the hopper 3 is provided in the hopper in order to direct the flow of the burning material A toward the center of the hopper 3. Angles are used to secure the hopper in the furnace and are attached to sidewall member 6. A combustion air inlet 29 is provided near the hopper to remove combustion air therefrom through line 31. The hopper 3, the baffles 5, the combustion air inlet 29 and the sidewall member 6 serve as a means for preventing upward backflow of combustion exhaust gas.

Hearth particles B are introduced into the furnace at an inlet 8 adjacent to the inlet 1 for the burning materials A. The hearth particles B fall along a chamber formed between the furnace sidewall 4 and an outer sidewall 9 into contact with an inclined channel member 12. The hearth particles B form a layer which flows down the inclined channel member 12 without being fluidized and at an angle approximately equal to the angle of repose of the hearth particles.

The incineration or combustion chamber 7 is an area of the furnace which is made up of the sloped hearth bed, a lower portion of the furnace outer wall 9 and a lower portion of the furnace sidewall 4. Since the combustion chamber is exposed to a high temperature, it is preferably made of fireproof materials.

A lower hearth bed member 10 is provided underneath the channel 12 and is inclined at an angle approximately equal to that of the channel member 12. A plurality of air inlets 11 are provided in the lower hearth bed member 10 in order to introduce combustion air into the sloped hearth bed. At least one channel member 12 is provided on the lower hearth bed member 10 and is provided with a plurality of small holes 13 or slits 14 for discharging combustion air into the sloped hearth bed. The inclined channel member 12 prevents the hearth particles B from coming into contact with the air inlets 11 provided in the lower hearth member 10 so that they do not impede the airflow from the pressure chamber 32 into the sloped hearth bed. The channel members 12 preferably do not have open upper ends or, if they do, the upper ends of the channel members 12 are closed to aid in the flow of the hearth particles. Additionally, the ends of the channel members 12 are also closed to prevent air leakage.

The hearth particles B that can be used in the present invention can be any type of particles, such as natural crushed mineral stone, coarse sand and iron particles, that are sufficiently durable under high temperature conditions and form sufficient gaps therebetween for air to flow between the hearth particles to the combustion chamber where they are contained therein as a hearth particle bed 15. A suitable main diameter of the hearth particles is greater than 5 mm, and preferably from about 1 cm to about 20 cm, and more preferably, from about 2 cm to about 10 cm.

The hearth particles B which form the hearth particle bed layer 15 sequentially moved by gravity continuously or intermittently along the top surface of the channel member 12 without being fluidized and, due to the surface of the channel member 12 being inclined at an angle approximately equal to the angle of repose of the hearth particles B, the layered shape of the hearth particle bed layer 12 does not change. The angle of repose of the hearth particles B can readily be determined by one of ordinary skill in the art depending on the characteristics of the materials and the shape and the diameter of the particles and the angle of inclination of the channel member 12 and lower hearth bed member 10 can be adjusted accordingly.

Figure 5:
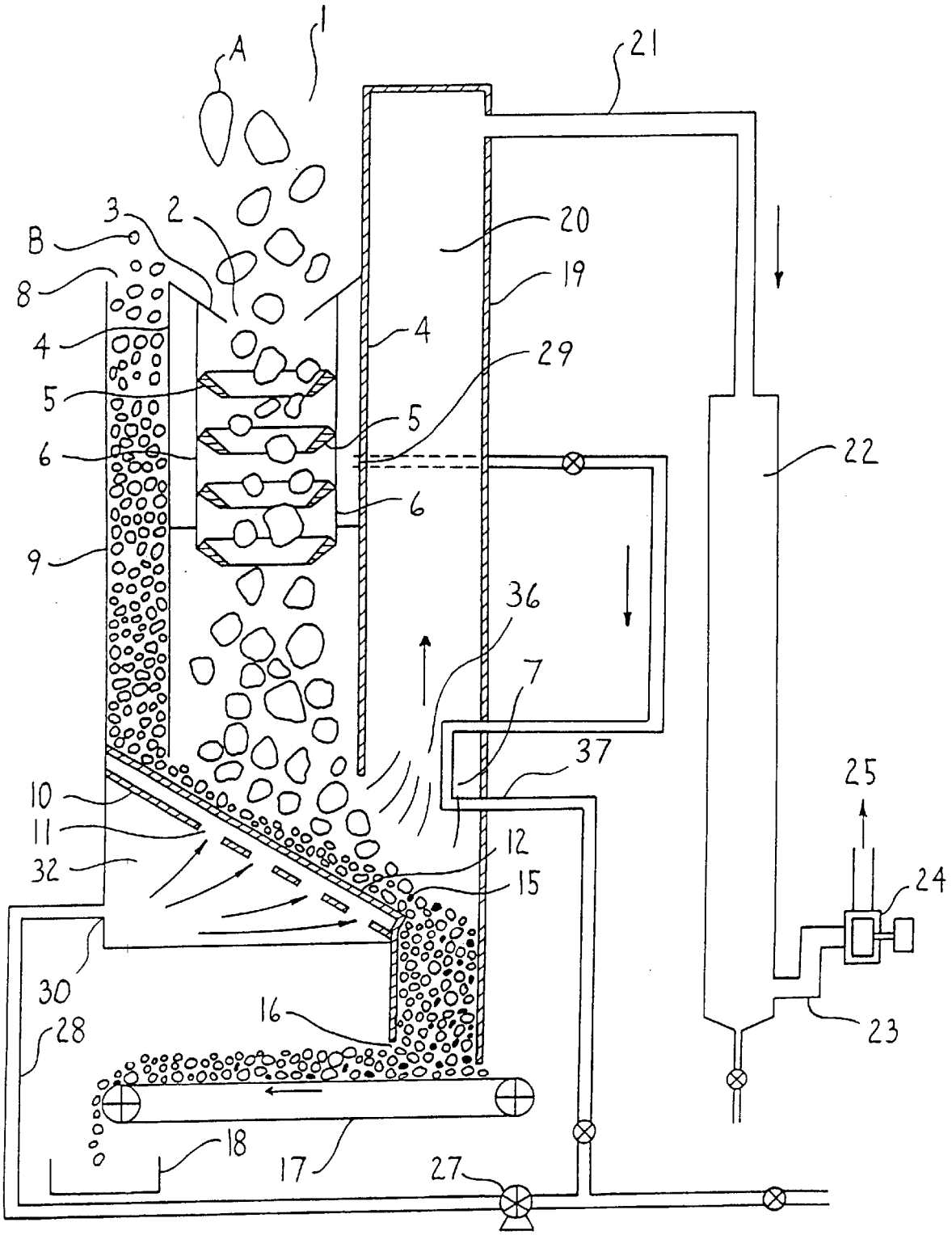
FIG. 5 is a partial sectional view illustrating an incinerating furnace according to a second embodiment of the present invention.
Figure 6:
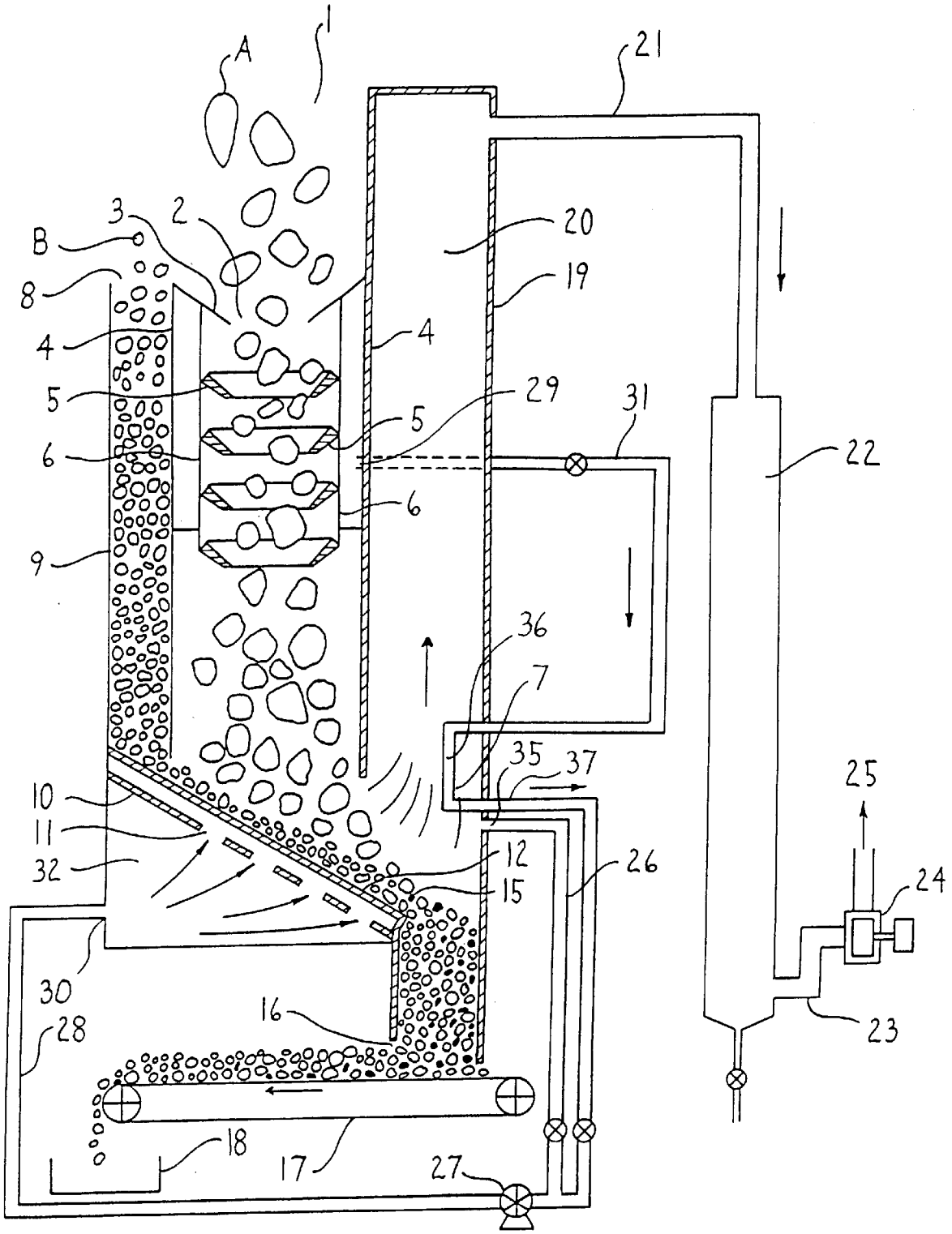
FIG. 6 is a partial sectional view illustrating an incinerating furnace according to a third embodiment of the present invention.

As illustrated in FIGS. 1, 5 and 6, air for the combustion of the incinerating furnace is drawn by a circulating fan 27 through combustion air inlet 29 and pipe 31 and exhausted in the pressure chamber 32 in order to supply combustion air to aid in the burning of materials A in the combustion chamber 7. The combustion air inlet 29 is located near the hopper 3 and aids in preventing the upward backflow of combustion exhaust gas. The location of the combustion air inlet 29 can be at one location or a plurality of locations and the number of inlets may be more than one. Additionally, the shape of the combustion air inlet 29 can be circular, rectangular, slit-shaped or any other suitable shape depending on the circumstances.

The width of the inlets 11 provided in the lower hearth bed member 10 can be as large as 3 to 10 cm in diameters in diameter. The slit 14 may have widths similar to the diameters of the small holes 13 and the length thereof is not fixed although the length of the slit is less than the length of the channel member 12 in order to avoid the weakening thereof.

In the furnace, the materials A incinerate and form a small amount of combustion residue C which mixes with hearth particles B and forms a combustion mixture D. The combustion mixture D exits the furnace via outlet 16 and onto a conveyor means 17 for removing the combustion mixture 16 from the furnace. Although a conveyor belt 17 is illustrated as a means for removing the combustion mixture, other mechanisms such as rotary gears, diaphragms and rotary cylinders can be also used.

As illustrated in FIG. 1, in the first embodiment of the present invention, combustion air is drawn through the combustion air inlet 29 through duct or pipe 31 and mixed with a portion of the combustion exhaust withdrawn at outlet 35 through pipe or duct 26 and mixed together to form a gas mixture which is introduced by fan 27 into the pressure chamber 32 to supply the gas mixture as a combustion gas for burning the materials to be burned A in the combustion chamber 7. The mixing of the combustion air with a portion of the exhaust gas creates a gas mixture having a temperature of from 150° to 650° C., preferably not less than 250° C. and especially about 250° to 450° C.

When a conveyor belt 17 is used as the means for removing the combustion mixture D, the combustion mixture D exits the outlet 16 of the furnace and falls onto the surface of the conveyor belt 17 at one end thereof. The outlet 16 is formed such that the combustion mixture D deposits on the conveyor belt 17 at an angle approximately equal to the angle of repose of the hearth particles B. Due to this design, the combustion mixture D removed from the outlet 16 does not spread over the area defined by the angle of the rest of the mixture D and the distance between the outlet 16 and the conveyor belt 17. As such, the combustion mixture D will not unexpectedly spread over the conveyor belt and spill if the conveyor belt is designed to have a certain area larger than the area required by the angle of repose and the distance between the conveyor belt 17 and the outlet 16. The distance between the outlet 16 and the conveyor belt 17 can be changed as desired.

Once the combustion mixture D is deposited on the conveyor belt 17, it is transported to a collection box 18 provided at the discharging of the conveyor belt. After being deposited in the collection box 18, the burnt ash C can be separated from the burnt remainders D by screening and the separated hearth particles recycled to the incinerating furnace.

The waste combustion exhaust gas produced by the incineration of material A travels up along wall 19, which is covered by fireproof material, and passes through a heat exchanger member 20, an exhaust pipe 21, a cooling and washing tower 22, a ventilating fan inlet 23, a ventilating fan 24 and is discharged through a chimney 25.

As explained previously, in the first embodiment of the present invention, combustion air is formed by mixing a portion of the combustion exhaust gas at a high temperature taken through inlet 25 and duct 26 with fresh air of room temperature taken from the combustion air intake 29 by the circulating fan 27 and introduced through duct 28 and supply inlet to the pressure chamber where it is supplied for burning material A through apertures 13, 14 formed in the channel member 12.

In the embodiment of the present invention illustrated in FIG. 5, combustion air is introduced at the combustion air inlet 29, passed through pipe 31 and heat exchange member 36, where the combustion air is heated through heat exchange through the combustion exhaust gas, and introduced by blower 27 through duct 28 into the pressure chamber 32 via supply inlet 30 to burn the materials A in the combustion chamber 7.

In the third embodiment of the incinerating furnace of the present invention, a portion of the exhaust gas is removed from the combustion chamber at outlet 25 and taken through duct 26 where it is mixed with the combustion air which is removed through combustion air inlet 29, duct 31 and then introduced into heat exchange member 36, where the combustion air is heated by the remainder of the combustion exhaust gas, and then transported through pipe 37. The mixed gas is then introduced into the pressure chamber 32 by blower 27 and the mixed gas used to burn materials A in the combustion chamber 7.

The shape of the hearth bed in the hearth bed furnace of the present invention is not critical and can be cylindrical, rectangular, quadrilateral or any other shape. Moreover, the horizontal cross-sectional shape of the inlet 1 can be of any hollow shape which allows the incinerating materials A to fall therein by gravity, such as a circle, oval, rectangle, etc.

Figure 2:
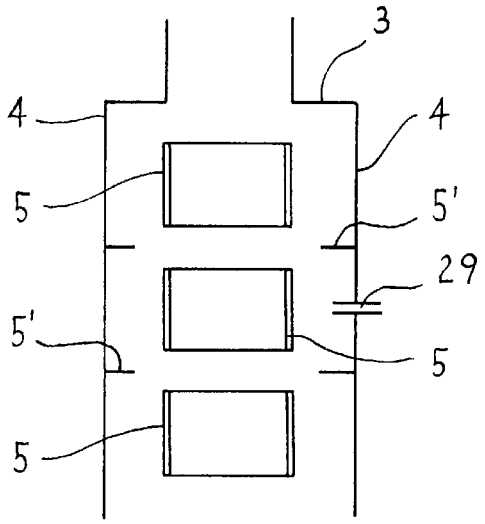
FIG. 2 illustrates an embodiment of a means for preventing upward backflow of combustion gas according to the present invention.

The hopper 3 is fixed to the inlet 1 of the furnace by angle joints so that it does not come in direct contact with the furnace sidewall 4. The shape of the baffles 5, 5' is that which provides some space between the hopper and the furnace sidewall and corresponds with the shape of the hopper 3 and furnace sidewall 4. Preferably, the central opening 2 of the hopper 3 narrows in diameter as it progresses along the length of the hopper 3 but the width of the central opening 2 is large enough to allow the burning materials A to fall freely therethrough. The angle of inclination of the hopper 3 should be an angle that enables the materials to be burned A to slide smoothly down therethrough and yet prevent, in cooperation with the baffles 5, the upward backflow of the exhaust gas. The angle of inclination of the hopper 3 is preferably from about 10 to 80 degrees, more preferably about 20 to 70 degrees, with respect to the sidewall of the inlet. The shape of the baffles 5, 5' can be as illustrated in FIGS. 1 and 2 or any other type of shape. If a plurality of baffles are used, they are preferably spaced a specific distance from each other. The width of the central opening of the baffle 5 is comparable to that of the hopper 3 and between the edge of the baffle 5 and an inlet sidewall, there is a space that an exhaust gas can flow upstream. The angle of orientation of the baffle is preferably the same as that of the hopper but the baffle 5 may have an angle that is different from that of the hopper 3. If possible, the baffles 5 are fixed to the furnace sidewall 4 of the incinerating furnace by angle joints which are strong enough to bare the physical shock caused by contact with the falling incinerating materials A.

OPERATION OF THE INVENTION

The operation of the hearth particle incinerating furnace of the present invention is as follows. Hearth particles B are continuously or intermittently introduced into the furnace through inlet 8 and fall by gravity in the chamber formed by furnace outer wall 9 and furnace sidewall 4 until they contact with the upper surface of channel member 12 where they form a hearth particle bed layer 15 which flows along the upper surface of the channel member 12 in a non-fluidized manner. Incinerating materials A are fed into the furnace through inlet 1 where they fall through a hopper 3 and are directed toward the center of the hopper by baffles 5 contained therein. The incinerating materials A fall through the hopper 3 and into the combustion chamber 7 into contact with the hearth particle bed layer 15 flowing down the channel member 12. Combustion air is removed through air intake 29 and either mixed with a portion of combustion exhaust gas removed from the combustion chamber 7 at the outlet 35 or heated by heat exchange member 36. The temperature of the combustion air is adjusted to about 150° to 600° C., preferably from 250° to 450° C. The high temperature of the air makes it possible to maintain the temperature of the burning materials high. The combustion air or mixture of the combustion air and the exhaust gas is introduced to the pressure chamber 32 by the blower 27 where it flows into the combustion chamber 7 through air inlets 11 provided in lower hearth bed member 10. The combustion air flows through the air inlets 11 and into contact with the channel members 12 where the airflow is redistributed by flowing through apertures 13 and 14 provided in the channels 12. The air finally flows through the spaces provided between the particles forming the hearth particle bed layer 15 and into the combustion chamber 7 to promote the burning of the materials A therein. Combustion residues C mix with the hearth particles B and exit from the furnace via outlet 16 and are deposited on a removal means such as the conveyor belt 17. The outlet 16 is shaped so that the mixture of combustion residue C and hearth particles B are deposited on the conveyor belt 17 at an angle equal to the angle of repose of the hearth particles B. As such, if the movement of the conveyor belt 17 stops, the discharge of the material out of the outlet 16 also stops. The conveyor belt carries a mixture of hearth particles B and combustion residue C to a container 18 where the hearth particles can be separated from the combustion residue and reused in the furnace.

The waste combustion exhaust gas travels up along wall 19, through heat exchanger member 20, and exhaust pipe 21 and into a cooling and washing tower 22. The gas is then sent through an exhaust pipe 23, a ventilating fan 24 and out of chimney 25. In some embodiments of the present invention, a portion of the high temperature waste exhaust gas is removed from the combustion chamber 7 at outlet 35 and transported through a duct 26 where it is mixed with combustion air from the combustion air inlet 29 and blown through air inlets 11 by blower 27 to promote burning of the materials A.

It is possible to control the removal rate of the combustion mixture by controlling the speed of the belt conveyor 17. The combustion mixture preferably is removed from the furnace after a residence time of more than 10 minutes, preferably from 30 minutes to 2 hours. As a result of this residence time, the combustion residue C can be heated to a temperature greater than 400° C., preferably from 400° to 600° C. for more than 30 minutes and, if dioxin is contained therein, it can be easily reduced.

EXAMPLE 1

Figure 3:
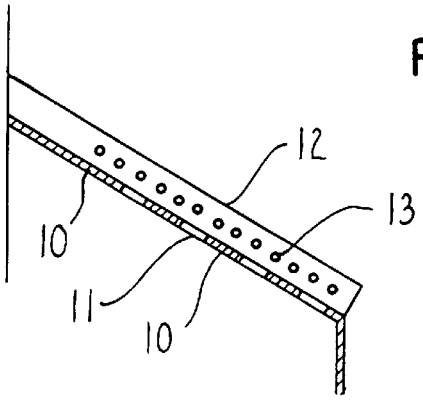
FIG. 3 is a schematic side view of the inclined channel member of the present invention.
Figure 4:
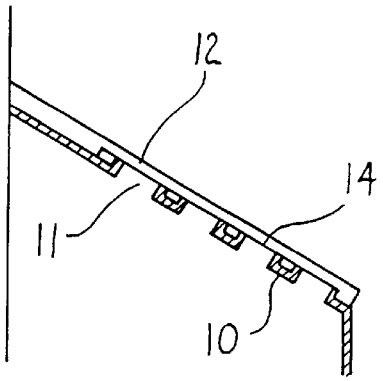
FIG. 4 is a schematic side view of the inclined channel member according to a second embodiment of the present invention.

The incinerating furnace illustrated in FIG. 1 and FIG. 3 was used for combustion. Crushed stones of 5 cm average diameter, which were crushed serpentine taken from Chichibu district of Saitama prefecture, were used as the hearth particles. Chips of crushed waste plastics mainly made of a chlorine compound containing used injectors were incinerated. In the incinerating furnace in which the area of the opening of the inlet 2 of the materials to be incinerated was 0.25 $m^2$, wastes to be incinerated having an average low calorific value of 2,000 Kcal/kg was introduced and burnt at the rate of 200 kg/hr.

In this case, the amount of air drawn from the opening 2 was 970 $Nm^3$/hr with the average speed of drawn air being about 1.1 m/sec.

Almost all the air drawn from the opening 2 was introduced through the air intake 29 and the duct 31 to be mixed with combustion exhaust gas of 1,200° C. and about 350 $Nm^3$/hr, drawn through the duct 26 from the upper portion of the combustion chamber 7. Consequently, gas having a temperature of about 320° C. and in a quantity of about 1,320 $Nm^3$/hr was produced and was blown by the circulating fan 27 through the pressure chamber 32 to the combustion chamber 7 to accomplish very effective combustion.

The state of the opening 2 of the inlet was very stable and cooperated with the member for restraining upward backflow of the exhaust gas. No upward backflow of combustion exhaust gas from inside the incinerating furnace was seen. In this case, the oxygen content inside the incinerating furnace was 6% by volume.

EXAMPLE 2

The incinerating furnace used in Example 1 was used again. In the incinerating furnace, waste to be incinerated having an average low calorific value of 2,000 Kcal/kg was introduced into the incinerating furnace and burnt at the rate of 200 kg/hr.

In this case, the amount of air drawn from the opening 2 was about 970 $Nm^3$/hr with the average speed of drawn air being about 1.1 m/sec.

All the air drawn from the opening 2 was mixed with exhaust gas in a total gas amount of about 1,100 $Nm^3$/hr and a comparatively low temperature from the hearth bed (layered hearth) just under the opening. The combustion air was then taken from the air intake 29 and introduced through the duct 31 to be mixed with combustion exhaust gas at a temperature of 1,200° C. which was taken out through the duct 26 from the upper portion of the combustion chamber 7. The amount of mixed gas was controlled to be 320° C. and it was blown by the circulating fan 27 through the pressure chamber 32 to the combustion chamber 7. Consequently very effective combustion was completed.

The state of the opening 2 of the inlet of materials to be incinerated was very stable and cooperated with the member for restraining upward backflow of the exhaust gas. No upward backflow of combustion exhaust gas from inside the incinerating furnace was seen.

In this case, the oxygen content inside the incinerating furnace was 6% by volume.

EXAMPLE 3

The incinerating furnace used in Example 1 was used again. In the incinerating furnace, waste to be incinerated having an average low calorific value of 2,000 Kcal/kg was introduced into the incinerating furnace and burnt at the rate of 200 kg/hr.

In this case, the amount of air drawn from the opening 2 was about 970 $Nm^3$/hr with the average speed of drawn air being about 1.1 m/sec.

With about 970 $Nm^3$/hr of air being drawn through the opening 2, about 700 $Nm^3$/hr of air was drawn from the air intake 29 as combustion air, introduced through the duct 31 and then mixed with exhaust gas at a temperature of 1,200° C. and about 250 $Nm^3$/hr, which was drawn through the duct 26 from the upper portion of the combustion chamber 7. Consequently, a mixed gas having a temperature of about 320° C. and quantity of about 950 $Nm^3$/hr was produced and was blown by the circulating fan 27 through the pressure chamber 32 to the combustion chamber 7 and was incinerated.

The state of the opening 2 of the inlet of materials to be incinerated was very stable and cooperated with the member for restraining upward backflow of the exhaust gas. No upward backflow of combustion exhaust gas from inside the incinerating furnace was seen.

The combustion state was almost fine as with Comparative Example 3, but compared to Examples 1 and 2 and Comparative Example 1, the flame intensity blown up from the incinerating hearth was comparatively weak.

In this case, the oxygen content inside the incinerating furnace was 6% by volume.

EXAMPLE 4

The incinerating furnace illustrated in FIG. 5 was used. In the incinerating furnace of which the area of the opening of the inlet 2 of materials to be incinerated was 0.25 $m^2$, waste to be incinerated having an average low calorific value of 2,000 Kcal/kg was introduced into the incinerating furnace and burnt at a rate of 200 kg/hr.

In this case, the amount of air drawn through the opening 2 was 970 $Nm^3$/hr with the average speed of the drawn air being about 1.1 m/sec.

Most of about 970 $Nm^3$/hr of air drawn through the opening 2 was taken into the combustion air intake 29 and introduced through the duct 31. It was heated to 320° C. by exchanging heat in heat exchanging member 36 and was blown by the circulating fan 27 through the pressure chamber 32 to the combustion chamber 7 and very effective combustion was completed.

The state of the opening 2 was very stable and cooperated with the member for restraining upward backflow of the exhaust gas. No upward backflow of combustion exhaust gas from inside the incinerating furnace was seen.

In this case, the oxygen content inside the incinerating furnace was 6% by volume.

EXAMPLE 5

The incinerating furnace illustrated in FIG. 6 was used. In the incinerating furnace of which the area of the opening of the inlet 2 of materials to be incinerated was 0.25 $m^2$, waste to be incinerated having a low average calorific value of 2,000 Kcal/kg was introduced into the incinerating furnace and burnt at the rate of 200 kg/hr.

In this case, the amount of air drawn through the opening 2 was about 970 $Nm^3$/hr with the average speed of the drawn air being about 1.1 m/sec.

With about 970 $Nm^3$/hr of air being drawn through the opening 2, about 840 $Nm^3$/hr of air was drawn from the air intake 29 as combustion air, introduced through the duct 31, and heated to 190° C. by the heat exchanging member 36 by the combustion exhaust of the incinerating furnace, and then mixed with combustion exhaust gas at a temperature of 1,200° C. and quantity of about 120 $Nm^3$/hr, which was drawn through the duct 26 from the upper portion of the combustion chamber 7. Consequently, mixed gas having a temperature of about 320° C. and quantity of about 960 $Nm^3$/hr was produced and blown by the circulating fan 27 through the pressure chamber 32 to the combustion chamber 7 and very effective combustion was completed.

The state of the opening 2 of the inlet of materials to be incinerated was very stable and cooperated with the member for restraining upward backflow of the exhaust gas. No upward backflow of combustion exhaust gas from inside the incinerating furnace was seen.

In this case, the oxygen content inside the incinerating furnace was 6% by volume.

COMPARATIVE EXAMPLE 1

Figure 7:
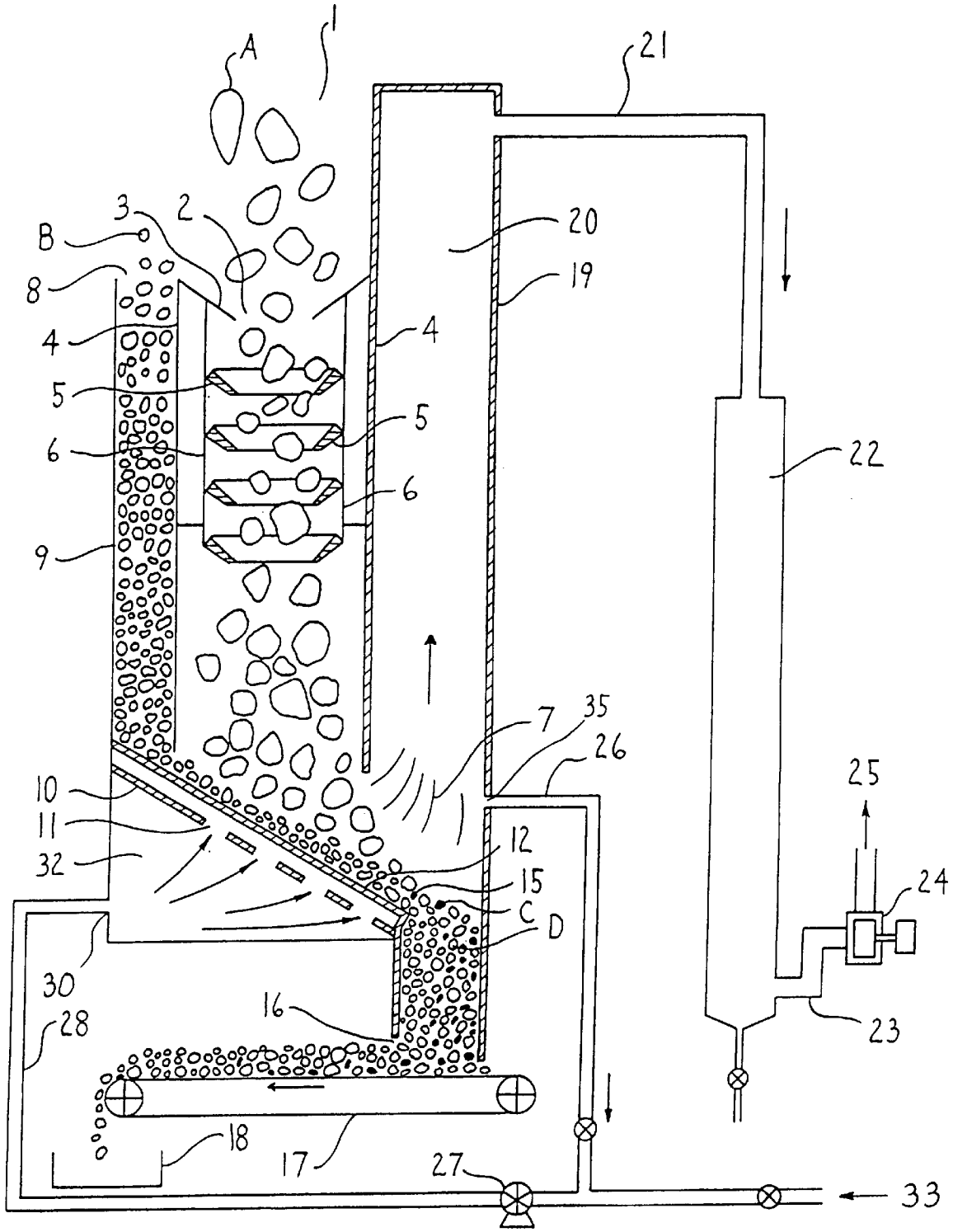
FIG. 7 is a partial sectional view of a first type of a comparative incinerating furnace used in the prior art.

The incinerating furnace illustrated in FIG. 7 was used. Waste to be incinerated having an average low calorific value of 2,000 Kcal/kg was introduced into the incinerating furnace and burnt at the rate of 200 kg/hr.

About 350 $Nm^3$/hr of exhaust gas, which was part of the air of about 1,200° C. drawn through the duct 26 from the upper portion of the combustion chamber 7, was mixed with air of 970 $Nm^3$/hr from outside the incinerating furnace. Consequently, gas having a temperature of about 320° C. and quantity was about 1,320 $Nm^3$/hr was produced and was blown through the pressure chamber 32 to the combustion chamber 7. Finally, very effective combustion was completed.

However, the amount of air drawn through the opening 2 was nearly zero and the gas in the combustion chamber occasionally exploded.

Therefore, the opening of the materials to be incinerated had to be closed.

In this case, the oxygen content inside the incinerating furnace was 6% by volume.

COMPARATIVE EXAMPLE 2

The incinerating furnace illustrated in FIG. 7 was used. Waste to be incinerated having an average low calorific value of 2,000 Kcal/kg was introduced into the furnace and burnt at the rate of 200 kg/hr.

A part of the exhaust gas having a temperature of about 1,200° C. and quantity of about 200 $Nm^3$/hr was drawn through the duct 26 from the upper portion of the combustion chamber 7 and mixed with air of 550 $Nm^3$/hr from outside the incinerating furnace.

Consequently, gas having a temperature of about 320° C. and quantity of about 750 $Nm^3$/hr was produced and blown through the pressure chamber 32 to the combustion chamber 7.

In this case, the drawn velocity of the air at the opening 2 of the inlet of materials to be incinerated was about 0.25 m/sec. Explosion of the gas in the combustion chamber at the opening was prevented to some extent, but it was not satisfactory. When using air from outside the incinerating furnace in an amount more than mentioned above, explosion of gas in the combustion chamber could not be prevented.

The burning state in this example was worse than in Examples 1 and 2 and Comparative Example 1.

In this case, the oxygen content inside the incinerating furnace was 6% by volume.

COMPARATIVE EXAMPLE 3

Figure 8:
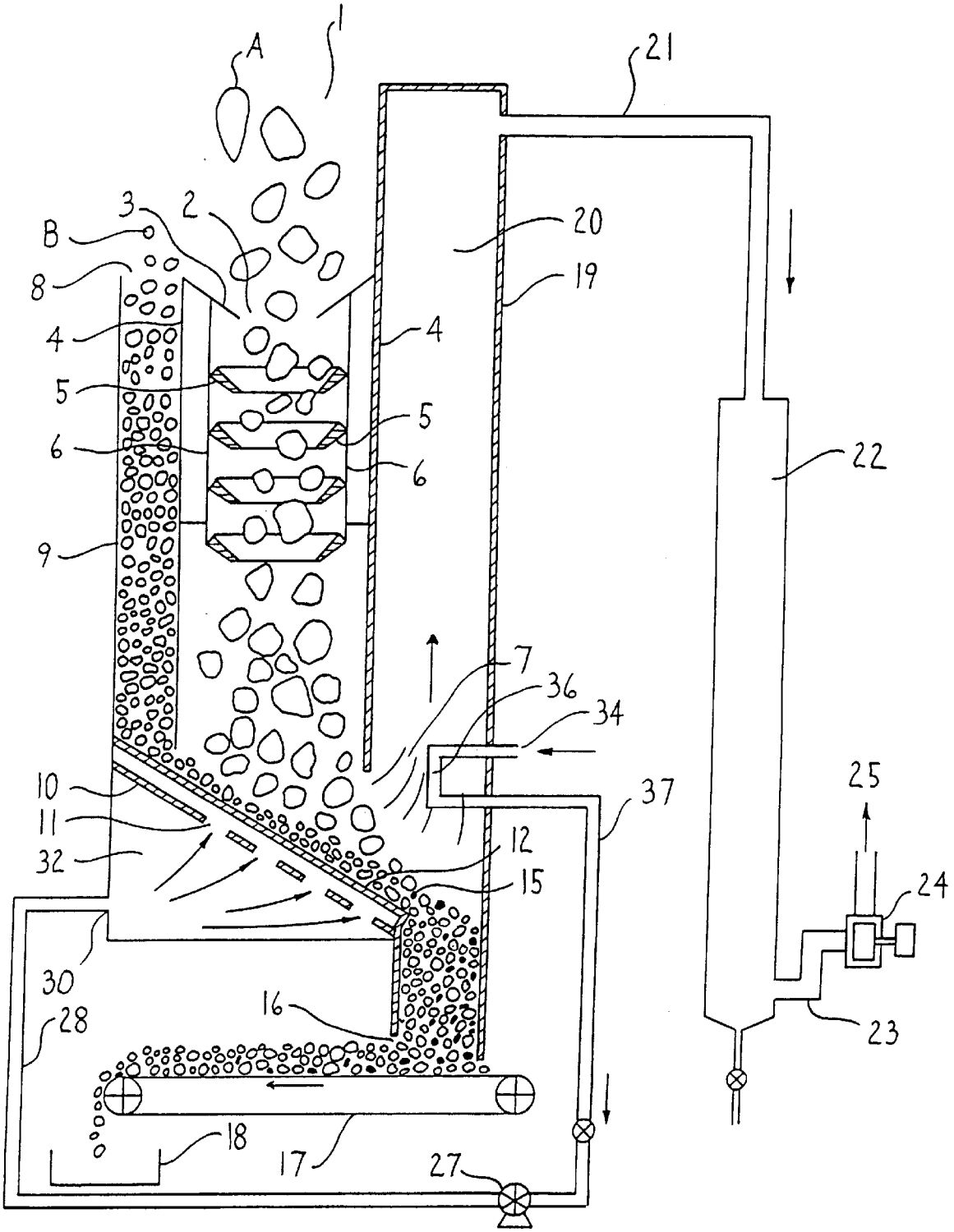
FIG. 8 is a partial sectional view of a second type of comparative incinerating furnace used in the prior art.

The incinerating furnace illustrated in FIG. 8 was used. Waste to be incinerated having an average low calorific value of 2,000 Kcal/kg was introduced into the incinerating furnace and burnt at the rate of 200 kg/hr. 970 $Nm^3$/hr of air at room temperature from outside the incinerating furnace was drawn from the air intake 34 and then heated to 320° C. by exchanging heat with the exhaust gas. Consequently, the heated air was blown through the pressure chamber 32 to the combustion chamber 7 and very effective combustion was completed.

However, the amount of air drawn through the opening 2 was nearly zero and the gas in the combustion chamber unsteadily exploded all the time. Therefore, the opening of the materials to be incinerated had to be closed.

In this case, the oxygen content inside the incinerating furnace was 6% by volume.

By using the furnaces of the present invention, the volume of air passing through the opening of the materials for incinerating is a large volume and by coordinating with the operation of the device for restraining upward backflow of the exhaust gas, the complete prevention of the backflow of combustion exhaust gas becomes possible, which is different from the conventional methods and devices.

What is claimed is:

1. A hearth particle bed incinerating furnace comprising a hopper for introducing materials to be incinerated; means for preventing upward backflow of combustion exhaust gas comprising the hopper, at least one baffle provided underneath the hopper, a combustion air inlet and a sidewall member provided underneath the hopper; a furnace sidewall extending around and underneath the sidewall member; a hearth particle inlet comprising a chamber formed between the furnace sidewall and a furnace outer wall; an inclined channel member attached to the furnace outer wall and provided underneath the hearth particle inlet; a sloped hearth bed formed on the inclined channel member, said sloped hearth bed comprising a layer of hearth particles which flow down the inclined channel member without being fluidized and at an angle approximately equal to the angle of repose of the hearth particles; a combustion chamber comprising the sloped hearth bed, a lower portion of the furnace outer wall and a lower portion of the furnace side wall; a furnace outlet provided underneath the combustion chamber for discharging a combustion mixture of burnt residue and hearth particles from the combustion chamber; means for removing a portion of the combustion exhaust gas from the combustion chamber; means for removing the remainder of the combustion exhaust gas provided at an upper portion of the combustion chamber; means for removing combustion air through the combustion air inlet; means for forming a mixed gas of the portion of the combustion gas and combustion air; means for introducing the mixed gas into the lower hearth bed for combustion; a movable plane member provided underneath the furnace outlet for removing the combustion mixture and means for regulating the discharge of the combustion mixture so that the combustion mixture deposits on the movable plane member at an angle approximately equal to the angle of repose of the hearth particles.

2. A hearth particle bed incinerating furnace comprising a hopper for introducing materials to be incinerated; means for preventing upward backflow of combustion exhaust gas comprising the hopper, at least one baffle provided underneath the hopper, a combustion air inlet and a sidewall member provided underneath the hopper; a furnace sidewall extending around and underneath the sidewall member; a hearth particle inlet comprising a chamber formed between the furnace sidewall and a furnace outer wall; an inclined channel member attached to the furnace outer wall and provided underneath the hearth particle inlet; a sloped hearth bed formed on the inclined channel member, said sloped hearth bed comprising a layer of hearth particles which flow down the inclined channel member without being fluidized and at an angle approximately equal to the angle of repose of the hearth particles; a combustion chamber comprising the sloped hearth bed, a lower portion of the furnace outer wall and a lower portion of the furnace sidewall; a furnace outlet provided underneath the combustion chamber for discharging a combustion mixture of burnt residue and hearth particles from the combustion chamber; means for removing combustion exhaust gas provided at an upper portion of the combustion chamber; means for removing combustion air through the combustion air inlet, heating the combustion air through heat exchange with the combustion exhaust gas and introducing the heated combustion air into the lower hearth bed for combustion; a movable plane member provided underneath the furnace outlet for removing the combustion mixture and means for regulating the discharge of the combustion mixture so that the combustion mixture deposits on the movable plane member at an angle approximately equal to the angle of repose of the hearth particles.

3. A hearth particle bed incinerating furnace comprising a hopper for introducing materials to be incinerated; means for preventing upward backflow of combustion exhaust gas comprising the hopper, at least one baffle provided underneath the hopper, a combustion air inlet and a sidewall member provided underneath the hopper; a furnace sidewall extending around and underneath the sidewall member; a hearth particle inlet comprising a chamber formed between the furnace sidewall and a furnace outerwall; an inclined channel member attached to the furnace outer wall and provided underneath the hearth particle inlet; a sloped hearth bed formed on the inclined channel member, said sloped hearth bed comprising a layer of hearth particles which flow down the inclined channel member without being fluidized and at an angle approximately equal to the angle of repose of the hearth particles; a combustion chamber comprising the sloped hearth bed, a lower portion of the furnace outer wall and a lower portion of the furnace sidewall; a furnace outlet provided underneath the combustion chamber for discharging a combustion mixture of burnt residue and hearth particles from the combustion chamber; means for removing a portion of the combustion exhaust gas from the combustion chamber; means for removing the remainder of the combustion exhaust gas provided at an upper portion of the combustion chamber; means for removing combustion air through the combustion air inlet and heating the combustion air through heat exchange with the combustion exhaust gas to form heated combustion air; means for forming a mixed gas of the portion of the combustion gas and heated combustion air; means for introducing the mixed gas into the lower hearth bed for combustion; a movable plane member provided underneath the furnace outlet for removing the combustion mixture and means for regulating the discharge of the combustion mixture so that the combustion mixture deposits on the movable plane member at an angle approximately equal to the angle of repose of the hearth particles.

* * * * *